US006561762B1

(12) United States Patent
Horng et al.

(10) Patent No.: US 6,561,762 B1
(45) Date of Patent: May 13, 2003

(54) HOUSING STRUCTURE OF A FAN

(75) Inventors: Alex Horng, Kaohsiung (TW); Ching-Shen Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 09/987,307

(22) Filed: Nov. 14, 2001

(51) Int. Cl.[7] ..... F04D 29/54
(52) U.S. Cl. ..... 415/211.2; 415/220
(58) Field of Search ..... 415/191, 208.2, 415/211.2, 176, 220, 221; 361/697; 417/354

(56) References Cited

U.S. PATENT DOCUMENTS 3,644,066 A * 2/1972 Heob et al. ..... 417/354
4,221,546 A * 9/1980 Papst et al. ..... 417/354
4,482,302 A * 11/1984 Grignon ..... 417/34
5,028,216 A * 7/1991 Harmsen et al. ..... 417/354
6,017,191 A * 1/2000 Harmsen ..... 416/247 R
6,386,276 B1 * 5/2002 Chen et al. ..... 165/121

* cited by examiner

*Primary Examiner*—Ninh H. Nguyen
(74) *Attorney, Agent, or Firm*—Bacon & Thomas

(57) ABSTRACT

A housing structure of a fan includes a housing having multiple support bars supporting a seat plate with which a stator is combined. An impeller has a rotation shaft rotatably mounted in the stator. Each of the support bars has two ends respectively connected to the housing and the seat plate. The cross-section of each of the support bars has a highest point, and has an air guide face and an air facing face respectively extended from the highest point, and a bottom face connecting the air guide face and the air facing face. The air guide face of each of the support bars is formed with an inclined face, and an acute included angle is formed between the inclined face and a vertical line that is vertical to a horizontal line of a bottom face of the seat plate.

5 Claims, 6 Drawing Sheets

HOUSING STRUCTURE OF A FAN

BACKGROUND OF THE INVENTION

1. Field of the Invention

The present invention relates to a housing structure of a fan, wherein the noise produced during rotation of the fan may be reduced, and rotation of the fan may produce a larger output air pressure at the air outlet.

2. Description of the Related Art

A conventional fan in accordance with the prior art shown in FIGS. 1–3 comprises a housing 90 for combination of a stator 91 which includes a bearing 92 having a shaft hole for pivot and rotation of a rotation shaft 94 of an impeller 93. When the impeller 93 is rotated, the blades 95 thereof may drive the air flow to move toward the air outlet of the housing 90. The air outlet of the housing 90 is provided with multiple support rods 96. The cross-sectional of each of the support rods 96 of the housing 90 has a semi-circular shape as shown in FIG. 2 or a quarter-circular shape as shown in FIG. 3. Thus, the air flow driven by the blades 95 of the impeller 93 is hindered by the support rods 96 of the housing 90, so that the air flow will deflect along the direction as indicated by arrows. Thus, the air flow driven by the blades 95 of the impeller 93 is hindered by the support rods 96 of the housing 90 to produce a turbulence, thereby causing noise. In addition, the air flow driven by the blades 95 of the impeller 93 is hindered by the support rods 96 of the housing 90, so that the output air pressure of the air flow driven by the blades 95 of the impeller 93 at the air outlet will be reduced.

SUMMARY OF THE INVENTION

The primary objective of the present invention is to provide a housing structure of a fan, wherein multiple support bars of the housing of the fan may be improved, so that the noise produced during rotation of the fan may be reduced, and rotation of the fan may produce a larger output air pressure at the air outlet.

In accordance with the present invention, there is provided a housing structure of a fan, comprising: a housing including multiple support bars supporting a seat plate with which a stator is combined, an impeller having a rotation shaft rotatably mounted in a shaft hole of the stator, each of the support bars having a first end connected to the housing and a second end connected to the seat plate, a cross-section of each of the support bars having a highest point, and having an air guide face and an air facing face respectively extended from the highest point, and a bottom face connecting the air guide face and the air facing face; the improvement comprising: the air guide face of each of the support bars is formed with a shape of an inclined face, and an acute included angle is formed between the inclined face of the air facing face and a vertical line that is vertical to a horizontal line of a bottom face of the seat plate.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
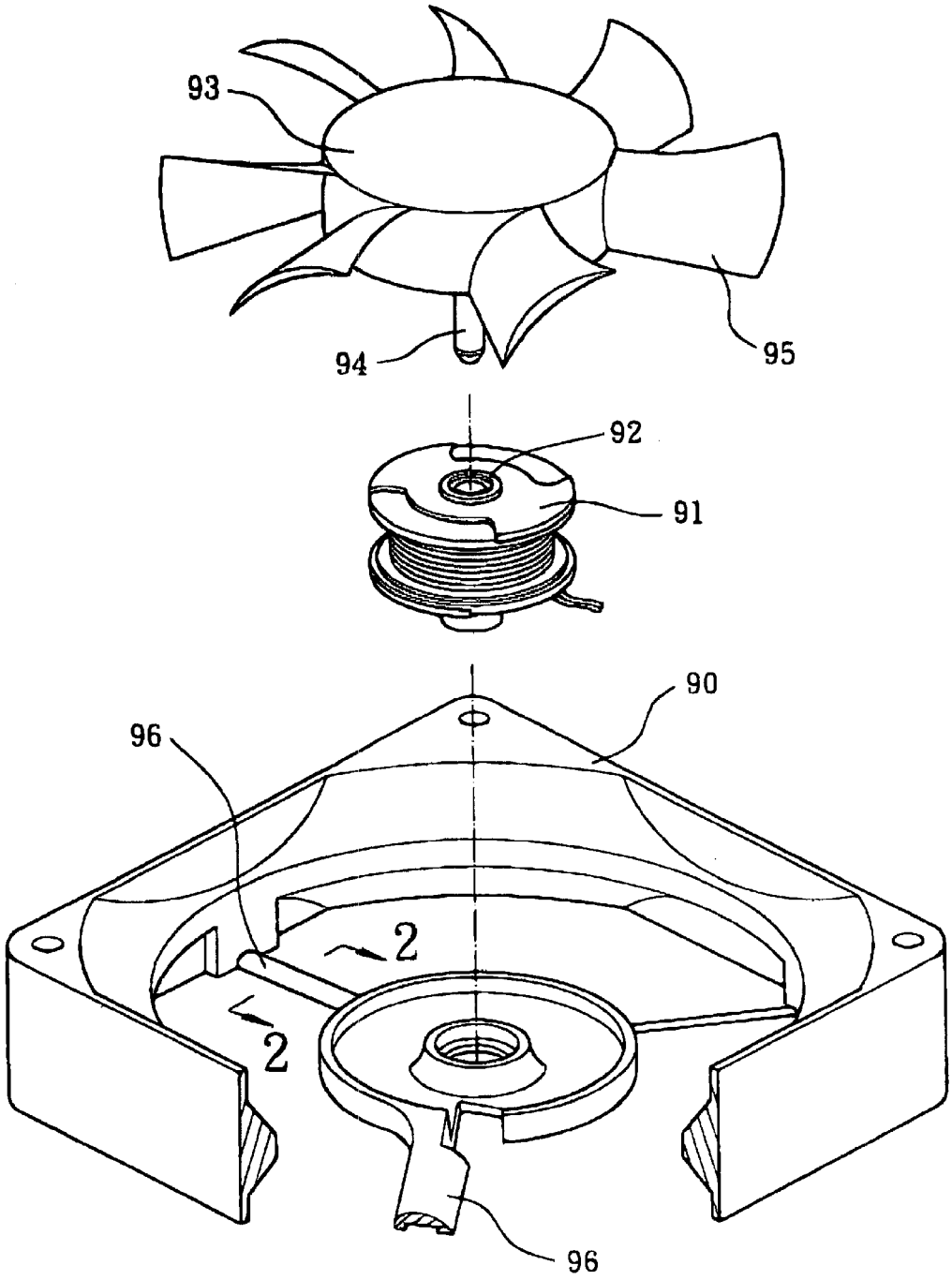
FIG. 1 PRIOR ART
FIG. 1 is an exploded perspective view of a conventional fan in accordance with the prior art.
Figure 2:
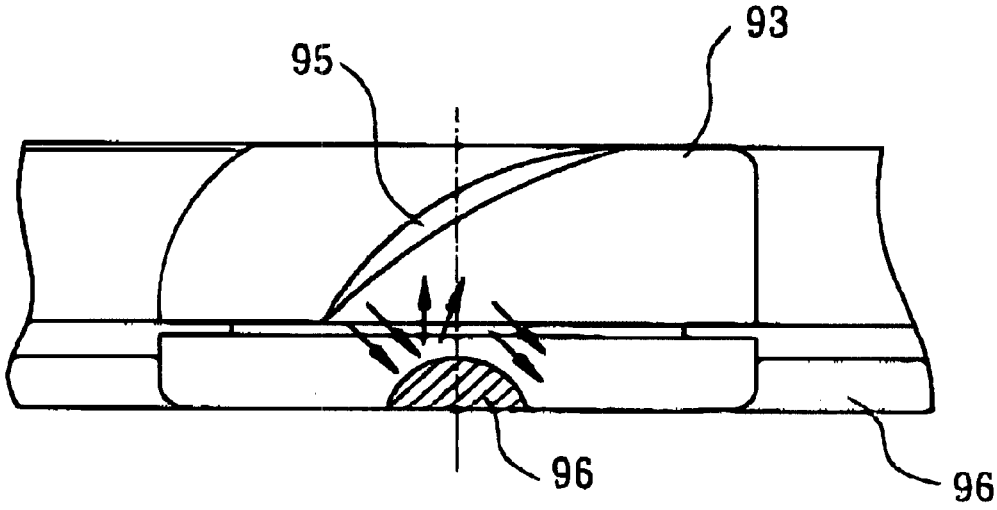
FIG. 2 PRIOR ART
FIG. 2 is a cross-sectional assembly view of the conventional fan taken along line 2—2 as shown in FIG. 1.
Figure 3:
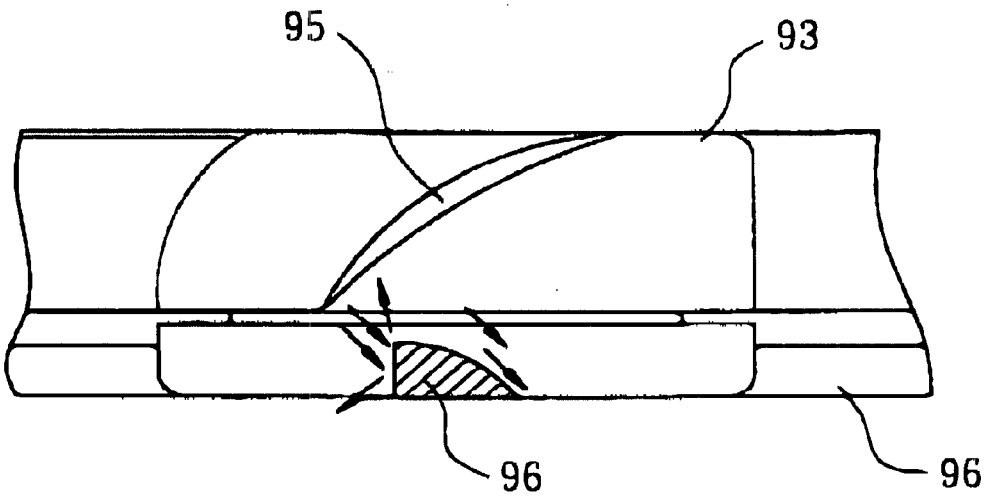
FIG. 3 PRIOR ART
FIG. 3 is a another cross-sectional assembly view of the conventional fan taken along line 2—2 as shown in FIG. 1.
Figure 4:
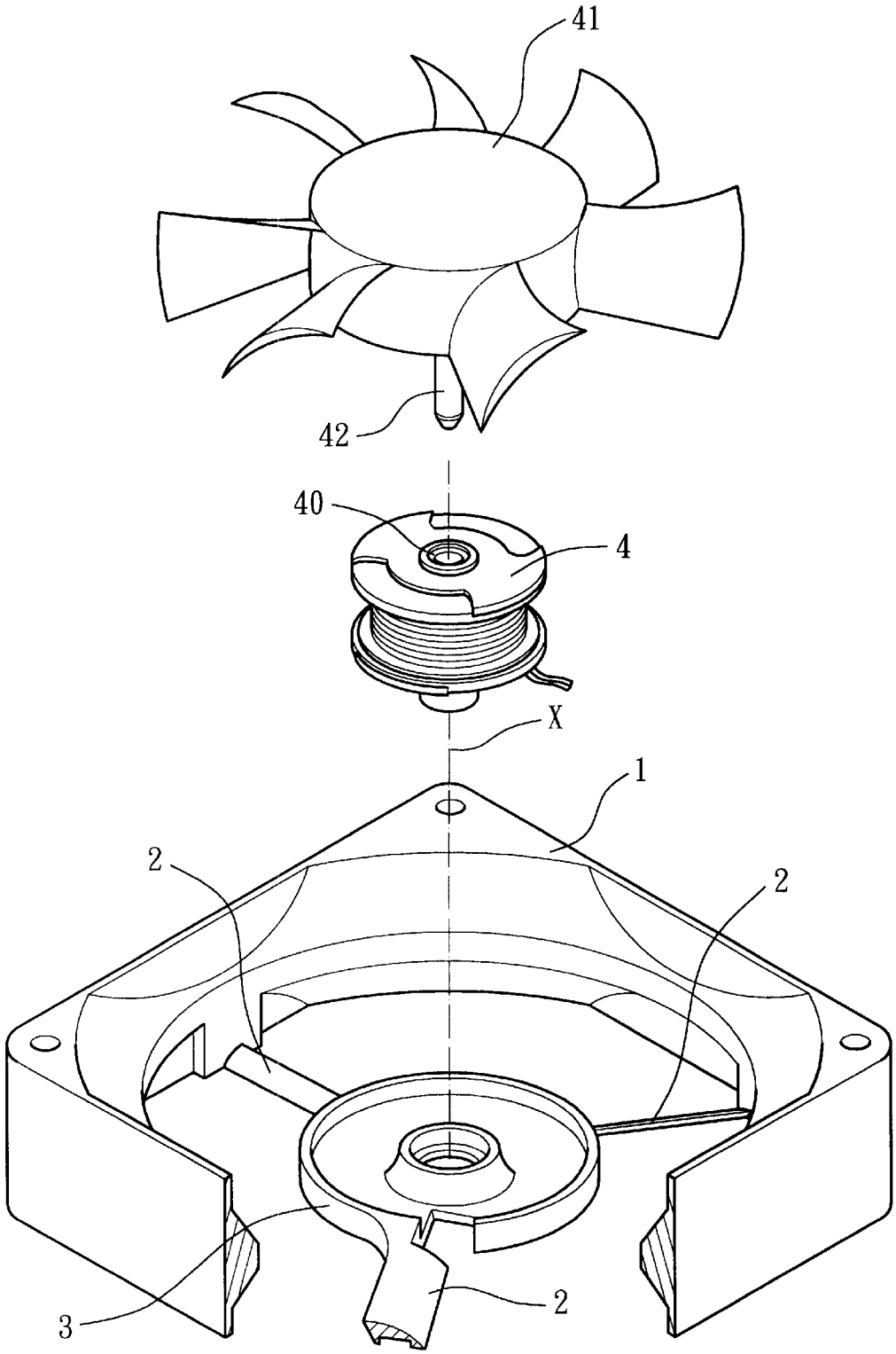
FIG. 4 is an exploded perspective view of a housing structure of a fan in accordance with a first embodiment of the present invention.
Figure 5:
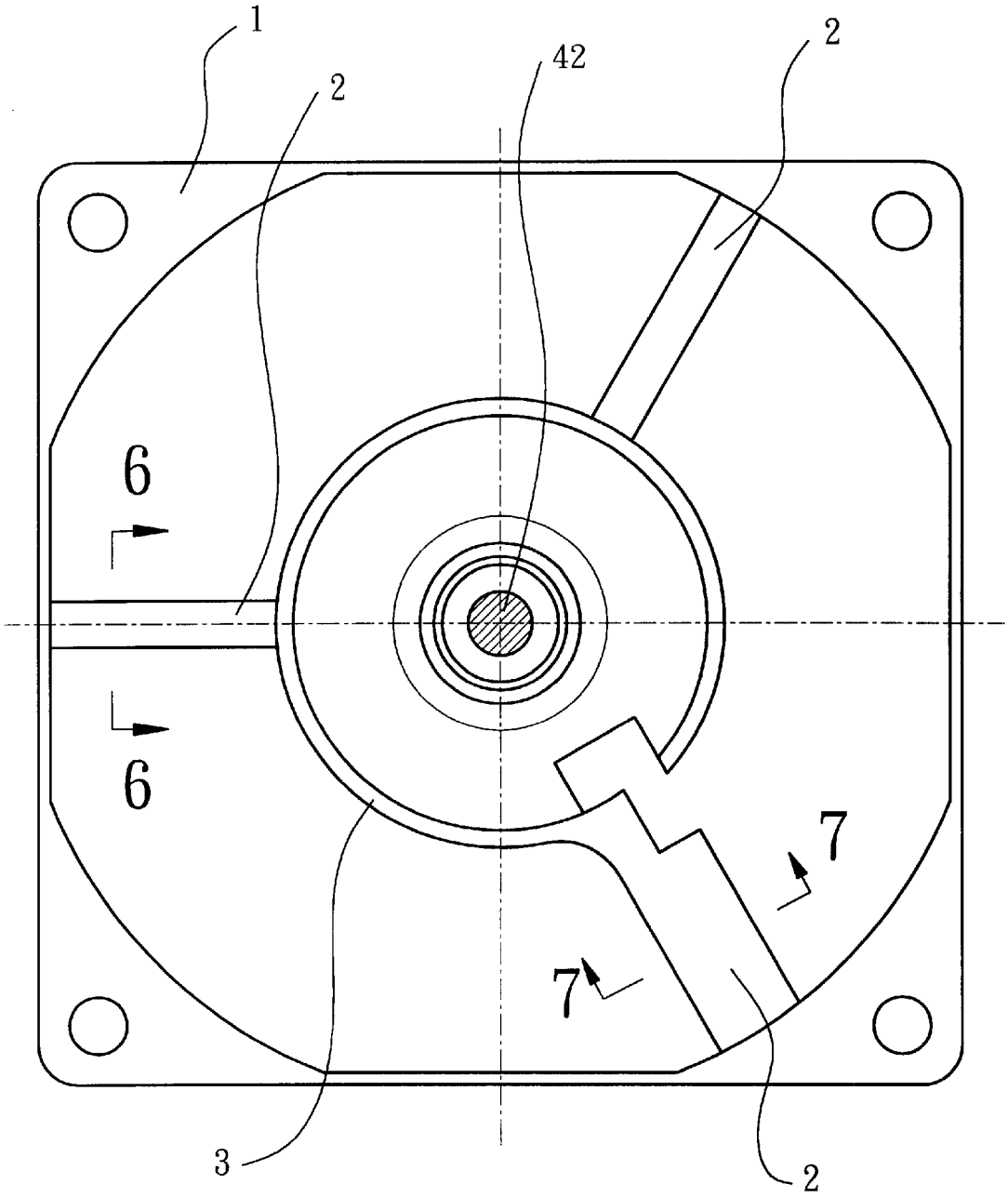
FIG. 5 is a top plan view of a housing of the housing structure of a fan as shown in FIG. 4.

Referring to the drawings and initially to FIG. 4, a housing structure of a fan in accordance with a preferred embodiment of the present invention comprises a housing 1 including multiple support bars 2 supporting a seat plate 3 with which a stator 4 is combined. An impeller 41 has a rotation shaft 42 rotatably mounted in a shaft hole 40 of the stator 4. The rotation shaft 42 of the impeller 41 has a center of rotation with a central axis X that is vertical to a horizontal line Y of a bottom face of the seat plate 3.

Figure 6:
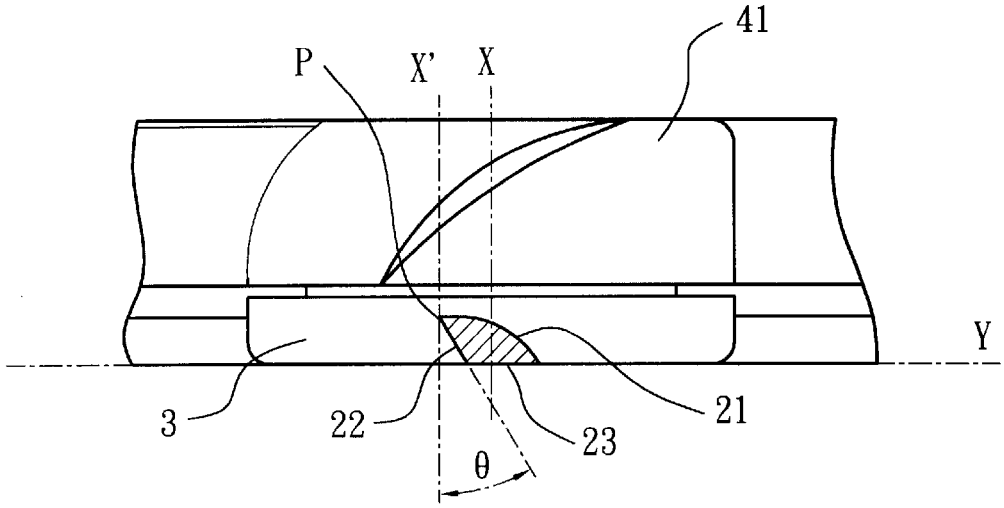
FIG. 6 is a cross-sectional assembly view of the housing structure of a fan taken along line 6—6 as shown in FIG. 5.

Referring to FIG. 6, the support bar 2 may be formed with different thickness according to different requirements, and has a first end connected to the housing 1 and a second end connected to the seat plate 3. The cross-section of the support bar 2 has an end point P, and has an air guide face 21 and an air facing face 22 extended from the end point P respectively, and a bottom face 23 for connecting the air guide face 21 and the air facing face 22. When the impeller 41 is rotated, the air flow driven by the blades of the impeller 41 will flow along the air guide face 21 and the air facing face 22. The air guide face 21 gradually reduces its height from the end point P, and is connected to the bottom face 23. The air guide face 21 may be formed with the shape of an inclined face, a circular plane or the like. The air facing face 22 is inclined from the end point P toward the horizontal line Y of the bottom face of the seat plate 3. An included angle θ is formed between the inclined face of the air facing face 22 and a vertical line X' that is in parallel with the central axis X. The included angle θ is an acute angle. Preferably, the included angle θ is ranged between 30° and 70°. Thus, when the air flow driven by the blades of the impeller 41 contacts the air facing face 22, the noise of turbulence may be reduced to the minimum. A test under the same conditions may be performed. The value of noise at one meter spaced from the conventional fan is 31.8 dB, and the value of noise at one meter spaced from the fan of the present invention is 31.6 dB. in addition, the output air pressure of the fan of the present invention may also be increased.

Figure 7:
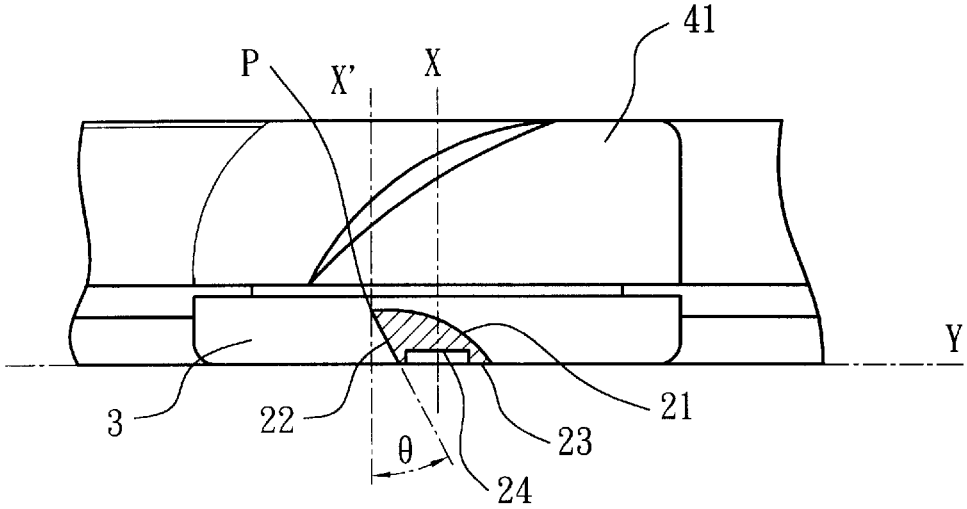
FIG. 7 is a cross-sectional assembly view of the housing structure of a fan taken along line 7—7 as shown in FIG. 5.

Referring to FIG. 7, the support bar 2 in accordance with a second embodiment of the present invention is shown. The bottom face 23 of at least one of the multiple support bars 2 is formed with a concave groove 24 for mounting electric cords in a sunk manner. Thus, the support bars 2 not only decrease the noise of turbulence and increase the output air pressure of the fan, but also protect the electric cords, so that the electric cords will not protrude from the air outlet of the fan, thereby preventing blocking the air output, and so that the housing may have a better outer appearance.

Figure 8:
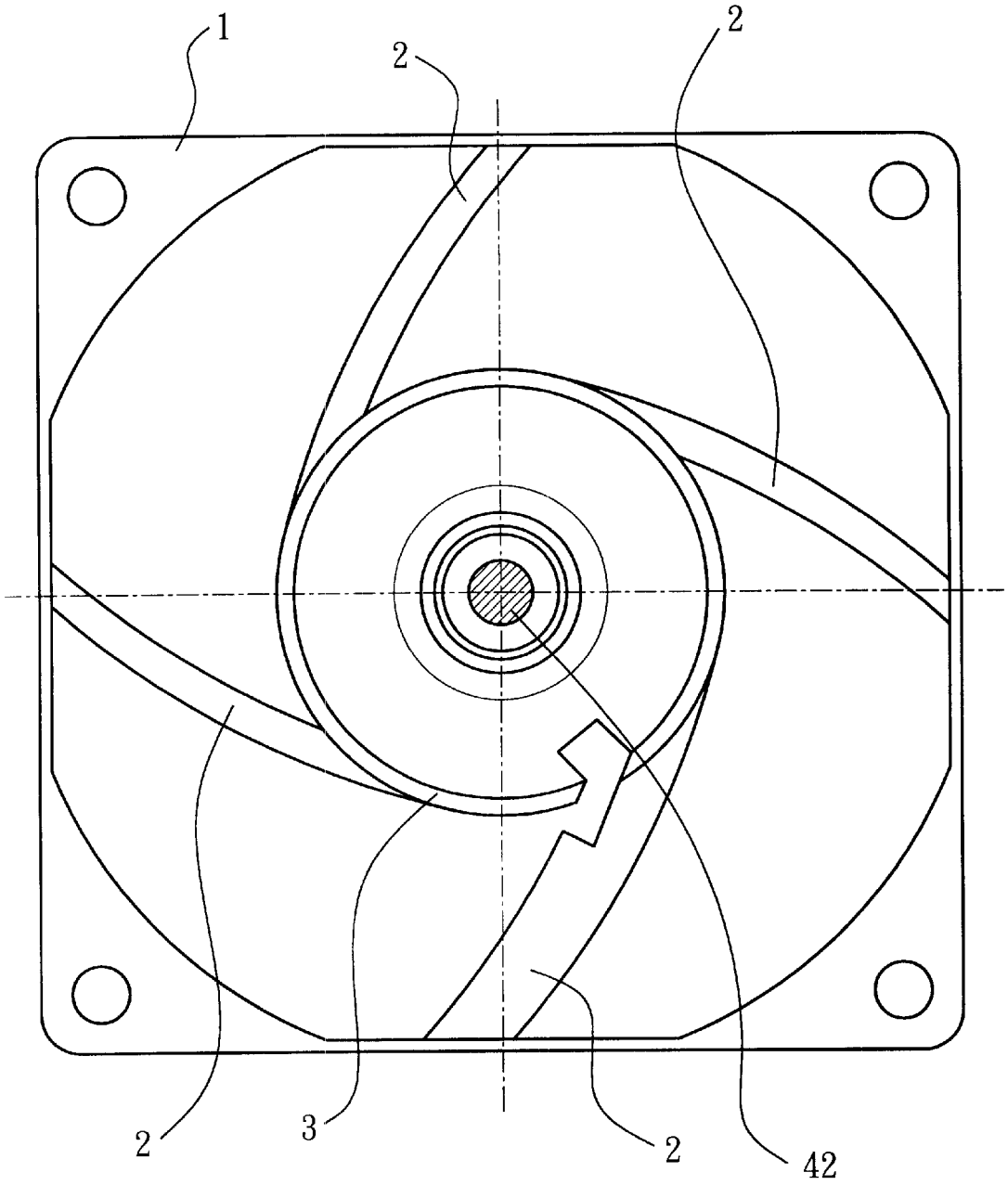
FIG. 8 is a top plan view of a housing structure of a fan in accordance with a second embodiment of the present invention.

Referring to FIG. 8, the support bar 2 in accordance with another embodiment of the present invention is shown. The support bar 2 may have the above-mentioned air guide face 21, air facing face 22, bottom face 23, and groove 24, and may also form an air facing arc-shaped bar according to the direction of rotation of the impeller 41, so that when the air flow driven by the blades of the impeller 41 contacts the arc-shaped support bar 2, the flow of the air flow is more convenient. Thus, the noise of turbulence may be reduced relatively, and the output air pressure of the fan may also be increased.

In conclusion, in accordance with the housing structure of a fan of the present invention, the noise of turbulence produced at the air outlet during rotation of the impeller may be reduced, and the output air pressure of the fan may also be increased. In addition, when the bottom face of the support bar is provided with a groove, the groove may be used for mounting electric cords in a sunk manner, so that the housing of the fan may have a better outer appearance.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A housing structure of a fan, comprising:

a housing including multiple support bars supporting a seat plate with which a stator is combined, an impeller having a rotation shaft rotatably mounted in a shaft hole of the stator, each of the support bars being located at an air discharge side of the impeller and having a first end connected to the housing and a second end connected to the seat plate, a cross-section of each of the support bars having a highest point, and having an air guide face and an air facing face respectively extended from the highest point, and a bottom face connecting the air guide face and the air facing face; wherein the air facing face of each of the support bars includes an inclined face extending from the highest point and inclined in a direction of rotation of the impeller, and an included angle is formed between the inclined face of the air facing face and a vertical line that is vertical to a horizontal line of a bottom face of the seat plate.

2. The housing structure of a fan as claimed in claim 1, wherein the air guide face of each of the support bars is an arc-shaped face.

3. The housing structure of a fan as claimed in claim 1, wherein the included angle formed between the inclined face of the air facing face of each of the support bars and the vertical line that is vertical to the horizontal line of the bottom face of the seat plate is ranged between 30° and 70°.

4. The housing structure of a fan as claimed in claim 1, wherein the bottom face of at least one of the multiple support bars is formed with a concave groove for mounting electric cords in a sunk manner.

5. The housing structure of a fan as claimed in claim 1, wherein at least one of said support bars of the housing forms an arc-shaped bar.

* * * * *